United States Patent [19]

Blazek

[11] Patent Number: 5,069,265

[45] **Date of Patent: * Dec. 3, 1991**

[54] METHOD OF MAKING A TURBINE ENGINE COMPONENT

[75] Inventor: William S. Blazek, Valley City, Ohio

[73] Assignee: PCC Airfoils, Inc., Cleveland, Ohio

[ * ] Notice: The portion of the term of this patent subsequent to Sep. 11, 2007 has been disclaimed.

[21] Appl. No.: 499,029

[22] Filed: Mar. 26, 1990

Related U.S. Application Data

[62] Division of Ser. No. 301,867, Jan. 25, 1989, Pat. No. 4,955,423.

[51] Int. Cl.[5] ..... B22C 9/04

[52] U.S. Cl. ..... 164/35; 164/10; 164/18; 164/112; 164/108; 29/889.22

[58] Field of Search ..... 164/34, 35, 36, 45, 164/91, 90, 98, 111, 112, 137, 122.1, 122, 9, 10, 11, 108; 29/889, 527.5, DIG. 5

[56] References Cited

U.S. PATENT DOCUMENTS

| | | | |
|---|---|---|---|
| 2,332,330 | 10/1943 | McMahan | 164/98 |
| 2,402.418 | 6/1945 | Kroon . | |
| 2,681,788 | 6/1954 | Wosika . | |
| 4,728,258 | 3/1988 | Blazek et al. | 164/361 |
| 4,955,423 | 9/1990 | Blazek | 164/98 |

*Primary Examiner*—Richard K. Seidel
*Assistant Examiner*—Rex E. Pelto
*Attorney, Agent, or Firm*—Tarolli, Sundheim & Covell

[57] ABSTRACT

A turbine engine component includes an annular array of airfoils which extend between inner and outer shroud rings. In order to accommodate thermal expansion of the airfoils, space is provided in a shroud ring rail. To provide space in the shroud ring rail, core material is positioned at the ends of the airfoils. The core material may be preformed separetely from the airfoils or may be a coating which is applied to end portions of the airfoils. Wax pattern material partially encloses the end portions of the airfoils and core material. The shroud ring pattern and the core material are covered with ceramic mold material to form a mold. The shroud ring pattern is then removed from the mold to leave the core material disposed in the shroud ring mold cavity at the end portions of the airfoils. As the mold is preheated, bonds between the core material and the airfoils are broken and the core material is gripped between end portions of the airfoils and the ceramic mold material. The shroud ring mold cavity is then filled with molten metal which is solidified to form the shroud ring. The core material is then removed from the shroud ring to leave space to accommodate thermal expansion of the airfoils.

13 Claims, 5 Drawing Sheets

METHOD OF MAKING A TURBINE ENGINE COMPONENT

This is a divisional of co-pending application Ser. No. 07/301,867 filed on Jan. 25, 1989 now U.S. Pat. No. 4,955,423.

BACKGROUND OF THE INVENTION

The present invention relates to a new and improved turbine engine component and the method by which it is made. Specifically, the present invention relates to a turbine engine component having a plurality of airfoils disposed in an annular array between inner and outer shroud rings.

A method of making a turbine engine component having an annular array of airfoils disposed between inner and outer shroud rings is disclosed in U.S. Pat. No. 4,728,258, issued Mar. 1, 1988 and entitled "Turbine Engine Component and Method of Making the Same". Slip joints are provided between the airfoils and a shroud ring to accommodate thermal expansion of the airfoils relative to the shroud ring. When the airfoils are heated to a temperature above the temperature of the shroud ring, thermal expansion of the airfoils causes the slip joints to open.

The turbine engine component design disclosed in the aforementioned U.S. Pat. No. 4,728,258 is generally satisfactory. However, the design of the shroud ring is relatively simplistic in that it has no mounting flanges or rails. The strength of the shroud ring tends to be minimized due to the presence of the openings in the shroud ring to accommodate the slip joints. Thus, the strength of the shroud ring is determined by relatively small sections of material which are disposed adjacent to the leading and trailing end portions of the airfoils.

It has previously been suggested that a turbine engine component having an annular array of airfoils disposed between inner and outer shroud rings be provided with a rail which facilitates mounting of the shroud ring in an engine and which strengthens the shroud ring. However, if the rail is to strengthen the shroud ring adequately, the rail may extend across the ends of the airfoils. In such a shroud ring design, the rail would interfere with expansion of the airfoils.

BRIEF SUMMARY OF THE INVENTION

The present invention provides a new and improved method of making an improved turbine engine component having a plurality of airfoils disposed in an annular array between shroud rings. Space is provided in a rail on at least one of the shroud rings to accommodate thermal expansion of the airfoils. When this improved turbine engine component is to be made, a plurality of airfoils are positioned in an annular array with end portions of the airfoils at least partially enclosed by a shroud ring pattern. Core material is disposed at the end portions of the airfoils. The core material may be either preformed to a desired configuration or coated over the end portions of the airfoils.

After the shroud ring pattern and core material have been covered with ceramic mold material, the shroud ring pattern is removed to leave a shroud ring mold cavity in which the core material is at least partially disposed. Thermal expansion of the airfoils breaks connections between the core material and the airfoils. The core material is then held against movement relative to the shroud ring mold cavity by being gripped between end portions of the airfoils and the ceramic mold material. The shroud ring mold cavity is filled with molten metal which is solidified to form the shroud ring. After the molten metal has solidified, the core material is removed from the shroud ring to leave space to accommodate thermal expansion of the airfoils.

BRIEF DESCRIPTION OF THE DRAWINGS

The foregoing and other objects and features of the present invention will become more apparent upon a consideration of the following description taken in connection with the accompany drawings wherein.

DESCRIPTION OF SPECIFIC PREFERRED EMBODIMENTS OF THE INVENTION

General Description

Figure 1:
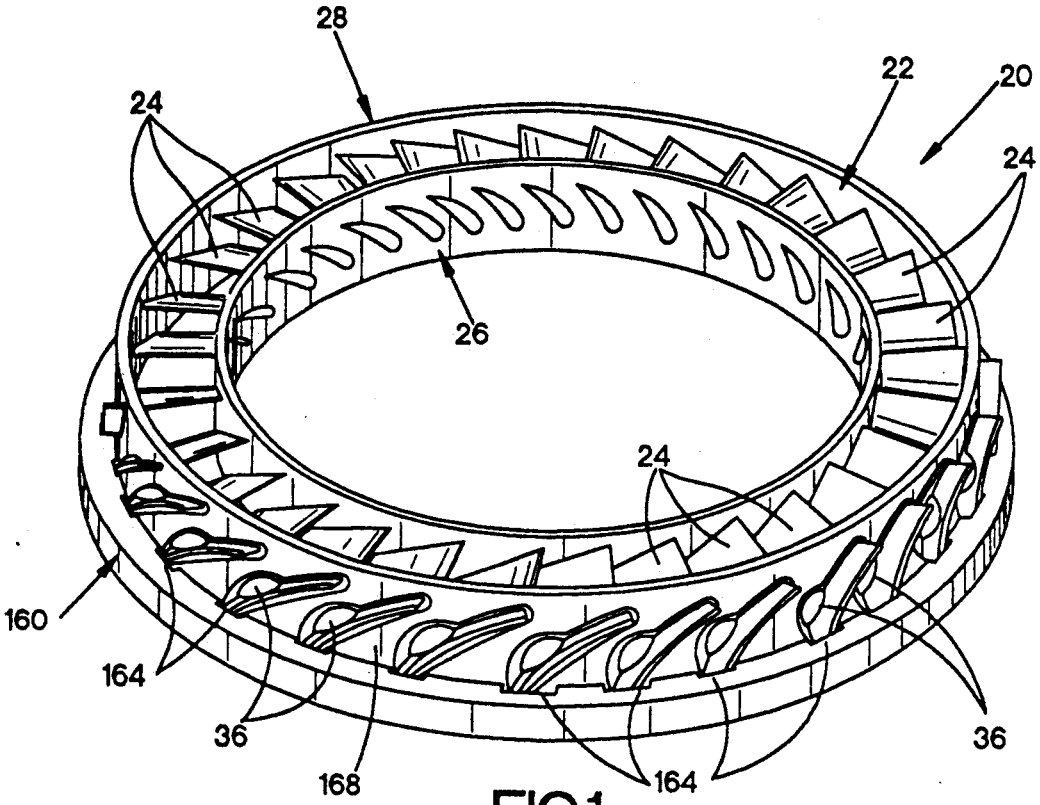
FIG. 1 is a pictorial illustration of a turbine engine component having a shroud ring with a rail which has space to accommodate thermal expansion of airfoils.

A turbine engine component 20 constructed in accordance with the present invention is illustrated in FIG. 1. In the present instance, the turbine engine component 20 is a stator which will be fixedly mounted between the combustion chamber and first stage rotor of a turbine engine. The hot gases from the combustion chamber are directed against an annular array 22 of airfoils or vanes 24 which extend between a one-piece cast inner shroud ring 26 and a one-piece cast outer shroud ring 28. Although it is believed that the turbine engine component 20 constructed in accordance with the present invention will be particularly advantageous when used between the combustion chamber and first stage rotor of a turbine engine, it should be understood that turbine engine components constructed in accordance with the present invention can be used at other locations in an engine.

The airfoils 24 are formed separately from the circular inner and outer shroud rings 26 and 28. This allows the airfoils 24 to be formed of metal and/or ceramic materials which can withstand the extremely high operating temperatures to which they are exposed in the turbine engine. Since the shroud rings 26 and 28 are subjected to operating conditions which differ somewhat from the operating conditions to which the airfoils 24 are subjected, the shroud rings 26 and 28 can advantageously be made of materials which are different from the materials of the airfoils 24.

The airfoils 24 (FIGS. 2–6) are formed separately from the shroud rings 26 and 28. In the present instance, the airfoils 24 are cast as a single crystal of a nickel-chrome superalloy metal. The airfoils 24 may be cast by a method generally similar to that disclosed in U.S. Pat. No. 3,494,709. However, it should be understood that the airfoils 24 could be formed with a different crystallographic structure and/or of a different material if desired. For example, it is contemplated that the airfoils 24 could have a columnar grained crystallographic metal structure or could be formed of a ceramic or metal and ceramic material if desired.

Figure 6:
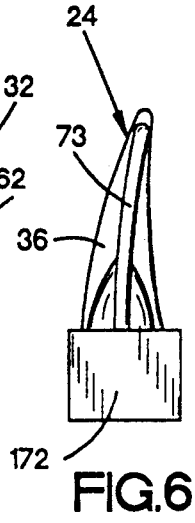
FIG. 6 is an end view, taken generally along the line 6—6 of FIG. 5, further illustrating the relationship between the core material and the end portion of the airfoil.
Figure 7:
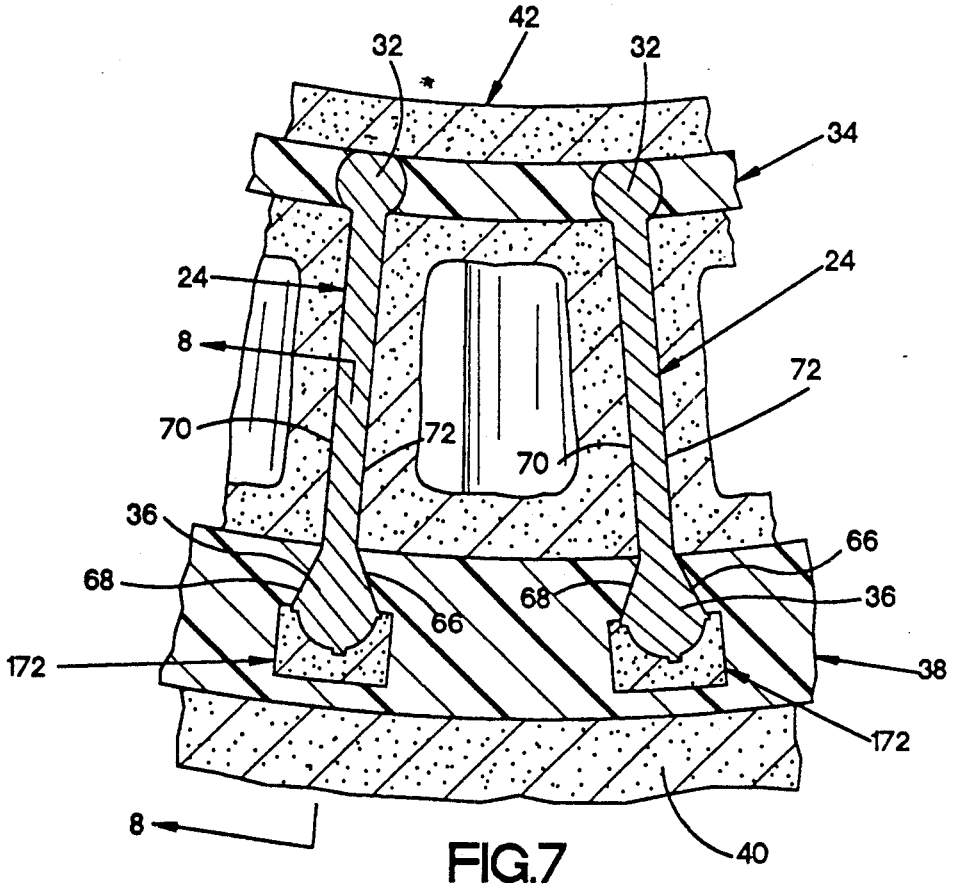
FIG. 7 is a fragmentary sectional view illustrating the manner in which ceramic mold material covers the airfoils, shroud ring patterns and core material during the making of a mold to cast the turbine engine component of FIG. 1.
Figure 8:
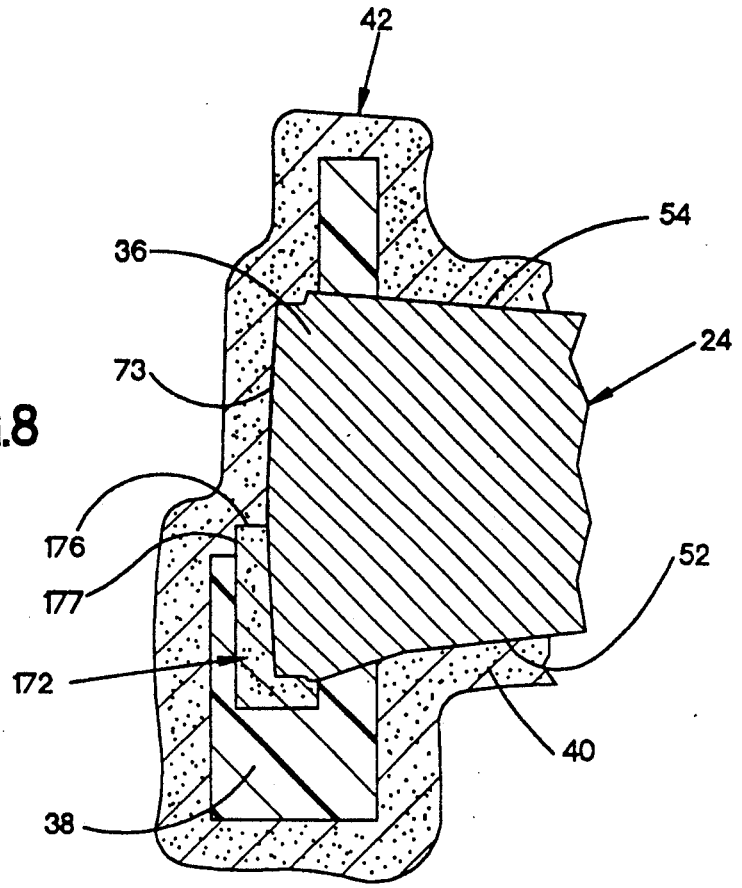
FIG. 8 is a sectional view, taken generally along the line 8—8 of FIG. 7, further illustrating the relationship between an end portion of an airfoil, shroud ring pattern, core material, and ceramic mold material.

To fabricate the turbine engine component 20, an inner end portion 32 (FIGS. 2 and 5) of the metal airfoil 24 is embedded in an annular wax inner shroud ring pattern 34 (FIG. 7). Similarly, an outer end portion 36 (FIGS. 5 and 6) of each of the metal airfoils 24 is embedded in a wax outer shroud ring pattern 38 (FIGS. 7 and 8). The airfoils 24 and wax inner and outer shroud ring patterns 34 and 38 are covered with ceramic mold material 40 to form a mold 42.

Figure 9:
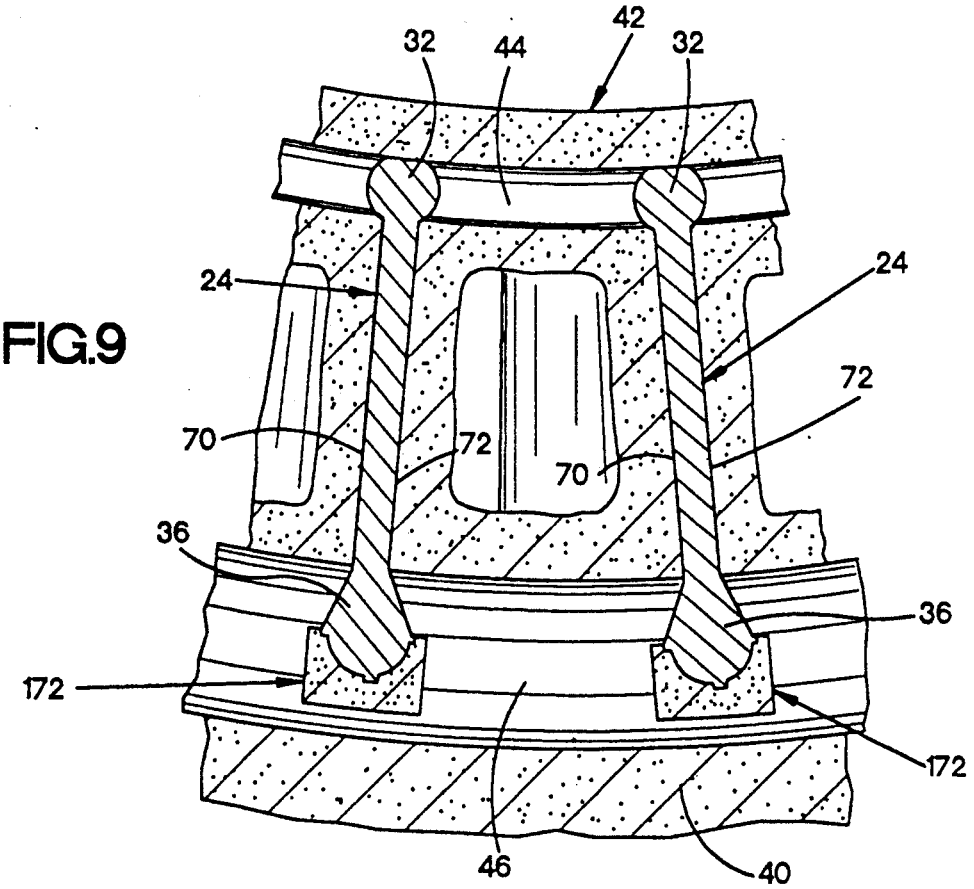
FIG. 9 is a fragmentary sectional view illustrating the relationship between the airfoils, core material, and shroud ring mold cavities formed by removing the shroud ring patterns of FIG. 7.

The wax material of the shroud ring patterns 34 and 38 is then removed from the mold 42 to leave a pair of circular shroud ring mold cavities 44 and 46 (FIG. 9). The shroud ring mold cavities 44 and 46 extend around the inner and outer end portions 32 and 36 of the airfoils 24.

Figure 10:
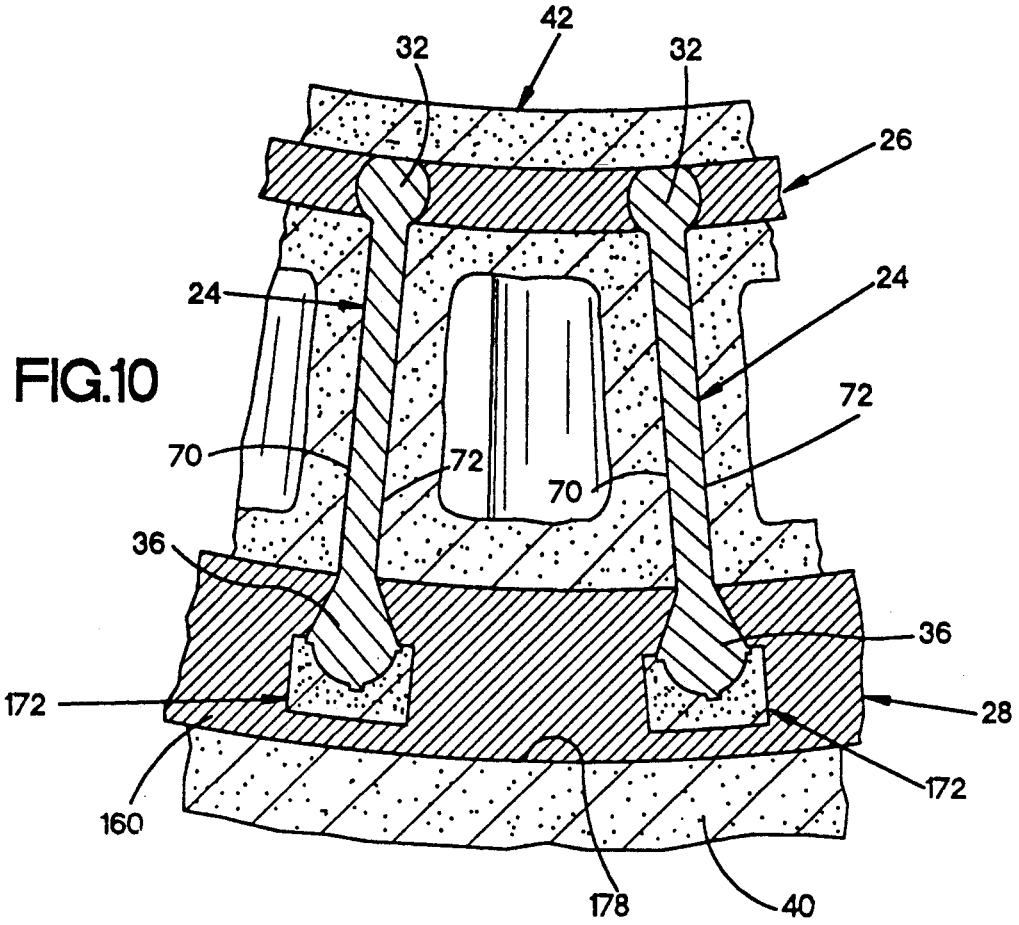
FIG. 10 is a fragmentary sectional view illustrating the relationship between the airfoils, core material and shroud rings cast in the shroud ring mold cavities of FIG. 9.

The shroud ring mold cavities 44 and 46 are then filled with molten metal. The molten metal solidifies to form inner and outer shroud rings 26 and 28 (FIG. 10). As the molten metal solidifies, the airfoils 24 act as chills to promote solidification of the molten metal of the shroud rings in a direction which is transverse to the leading and trailing edges 52 and 54 (FIG. 5) of the airfoils 24.

An oxide covering forms over the metal airfoils 24 during processing of the airfoils. The oxide covering inhibits the formation of bonds between the airfoils 24 and shroud rings 26 and 28. Thus, there is only a mechanical interconnection between the shroud rings 26 and 28 and the airfoils 24.

Since the shroud rings 26 and 28 are each cast as one-piece separately from the airfoils 24, the shroud rings can be formed of a metal which is different than the metal of the airfoils 24. Thus, in the specific instance described herein, the airfoils 24 were cast as single crystals of a nickel-chrome superalloy while the inner and outer shroud rings 26 and 28 were formed of a nickel chrome or cobalt chrome superalloy, such as MAR M509. Although the one-piece inner and outer shroud rings 26 and 28 were cast of the same metal, it is contemplated that the inner shroud ring 26 could be cast of one metal and the outer shroud ring 28 cast of another metal. The airfoils 24 would be formed of a third metal or ceramic material in order to optimize the operating characteristics of the turbine engine component 20.

During operation of a turbine engine, the airfoils 24 will be heated to a higher temperature than the inner and outer shroud rings 26 and 28. Due to the fact that the airfoils 24 are heated to a higher temperature than the shroud rings 26 and 28, there will be greater thermal expansion of the airfoils 24 than the shroud rings. Slip joints 58 (FIGS. 2 and 3) are provided between the outer shroud ring 28 and the outer end portion 36 of each of the airfoils 24 to accommodate thermal expansion of the airfoils. Although the slip joints 58 have been shown as being between the outer shroud ring 28 and the airfoils 24, the slip joints 58 could be between the inner shroud ring 26 and the airfoils if desired, using the outer shroud as the attachment shroud.

The inner end portions 32 of each of the airfoils 24 is anchored in and held against axial movement relative to the inner shroud ring 26. Therefore, upon heating of the airfoils 24 to a temperature which is above the temperature of the shroud rings 26 and 28, each airfoil 24 expands radially outwardly and opens a slip joint 58 (FIG. 4) between the outer end portion 36 of the airfoil and the outer shroud ring 28. By opening the slip joints 58 in the manner illustrated in FIG. 4, the application of thermal stresses to the airfoils 24 is avoided. Since there are no metallurgical bonds between the airfoils 24 and the outer shroud ring 28, the slip joint 58 are readily opened with the application of a minimum of stress to the airfoils.

Each of the identical airfoils 24 (FIG. 5) has a relatively wide inner end portion 32. Thus, the inner end portion 32 has a flange section 62 which extends outwardly from the leading edge portion 52 of the airfoil. The outwardly projecting flange section 62 provides for a mechanical interconnection between the airfoil 24 and the inner shroud ring 26 throughout a substantial arcuate distance along the shroud ring 26. In addition, the inner end portion 32 of the airfoil has a bulbous configuration to provide for a mechanical interlocking between the inner shroud ring 26 and the inner end portion 32 of the airfoil 24. Due to the mechanical connection between the inner end portion 32 of the airfoil 24 and the inner shroud ring 26, the inner end portion 32 of each airfoil 24 is anchored and cannot move radially outwardly of the inner shroud ring.

Figure 2:
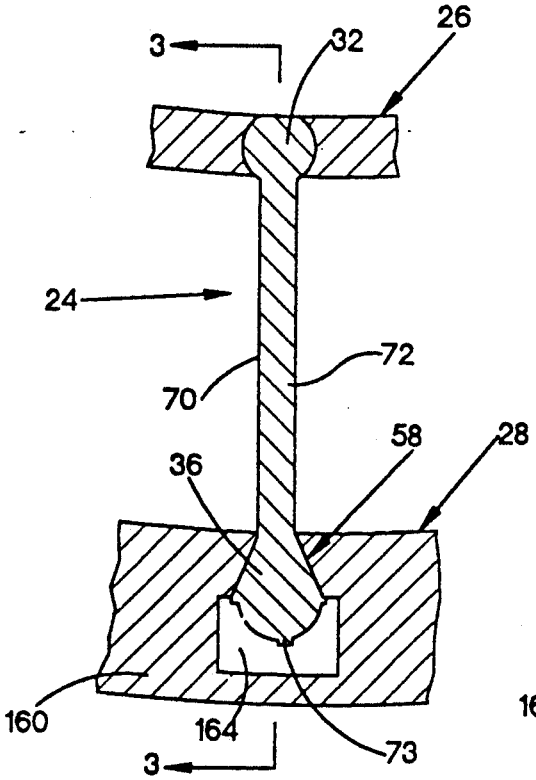
FIG. 2 is a schematic sectional view illustrating the relationship between an airfoil and shroud ring rail of the turbine engine component of FIG. 1 when the airfoil and shroud ring are at the same temperature.

The outer end portion 36 of the airfoil 24 is tapered inwardly from the outer shroud ring 28 toward the inner shroud ring 26 (FIG. 2). Thus, the outer end portion 36 of the airfoil 24 has a pair of sloping side surface areas 66 and 68 (FIG. 4) which slope radially inwardly to a concave major side surface 70 and a convex major side surface 72. In addition, the outer edge portion 36 of the airfoil 24 has an end section 73. The end section 73 (FIG. 8) and side surfaces 70 and 72 (FIG. 7) engage the ceramic mold material 40 to firmly anchor the airfoil 24 in place in the mold 42.

The wax shroud ring patterns 34 and 38 (FIGS. 7 and 8) are formed by interconnecting inner and outer shroud ring pattern segments in the manner disclosed in U.S. Pat. No. 4,728,258, issued Mar. 1, 1988 and entitled "Turbine Engine Component and Method of Making the Same". In order to cast the inner and outer shroud rings 26 and 28, a pattern assembly is fabricated. The pattern assembly includes the wax inner shroud ring pattern 34, the wax outer shroud ring pattern 38, and a wax gating pattern. The wax gating pattern, like the shroud ring patterns 34 and 38, can be formed of either a natural wax or an artificial substance having characteristics which are generally similar to natural waxes. The manner in which the wax pattern assembly is formed is the same as disclosed in U.S. Pat. No. 4,728,258.

Once the pattern assembly has been completed, it is covered with a suitable mold material. The mold material solidifies over the outside of the wax patterns and, upon removal of the material of the wax patterns, forms a mold having cavities with configurations corresponding to the configuration of the wax pattern assembly.

In order to form a mold 42, the entire pattern assembly is completely covered with liquid ceramic mold material. The ceramic mold material 40 (FIG. 7) completely covers the exposed surfaces of the metal airfoils 24, wax inner shroud ring 34, wax outer shroud ring 38 and wax gating pattern. The entire pattern assembly may be covered with the liquid ceramic mold material by repetitively dipping the pattern assembly in a slurry of liquid ceramic mold material.

Although many different types of slurries of ceramic mold material could be utilized, one illustrative slurry contains fused silica, zircon, and other refractory materials in combination with binders. Chemical binders such as ethalsilicate, sodium silicate and colloidal silica can be utilized. In addition, the slurry may contain suitable film formers, such as alginates, to control viscosity and wetting agents to control flow characteristics and pattern wettability.

In accordance with common practices, the initial slurry coating applied to the pattern assembly 88 may contain a finely divided refractory material to produce an accurate surface finish. A typical slurry for a first coat may contain approximately 29% colloidal silica suspension in the form of a 20% to 30% concentrate. Fused silica of a particle size of 325 mesh or smaller in an amount of 71% can be employed together with less than 1%-10% by weight of a wetting agent. Generally, the specific gravity of the ceramic mold material may be on the order of 1.75 to 1.80 and have a viscosity of 40 to 60 seconds when measured with of the initial coating, the surface is stuccoed with refractory materials having a particle size on the order of 60 to 200 mesh. Although one known specific type of ceramic mold material has been described, other known types of mold materials could be used if desired.

The ceramic mold material 40 (FIG. 7) overlies and is in direct engagement with the major side surfaces 70 and 72 of the metal airfoils 24. In addition, the mold material overlies the exposed end 73 of the airfoils 24 (see FIG. 8). Due to the inwardly tapered configuration of the end portions 36 of the airfoils 24, the ceramic mold material overlies the end portions where their cross sectional areas are a maximum.

Although the ends 73 of the airfoils have been shown as protruding outwardly, it is contemplated that the ends 72 of the airfoils could extend generally parallel to the side surface of the outer shroud ring pattern 38 if desired. Due to weight savings and space considerations, it is believed that the end portion 72 of the airfoils will be trimmed to eliminate any excess metal.

The ceramic mold material 40 completely encases the inner and outer shroud ring patterns 34 and 38 (FIG. 8). In addition, the ceramic mold material 40 overlies the wax gating pattern.

After the ceramic mold material 40 has dried, or at least partially dried, the mold 42 is heated in a steam autoclave to melt the wax material of the inner and outer shroud ring patterns 34 and 38 and the wax gating pattern. The melted wax is poured out of the mold 42 through an open end of the combination pour cup and downpole. A degreaser is then used to remove any remaining wax.

Once the mold 42 has been formed in the manner previously described, the mold is preheated to about 1800° F. The molten metal is poured into the preheated mold through the pour cup and downpole. The molten metal flows through gating passages to the upper and lower end portions of the shroud ring mold cavities 44 and 46.

While the molten metal is flowing into the shroud ring mold cavities 44 and 46, the airfoils are held against movement relative to each other and to the mold cavities by the ceramic mold material 40 engaging the major side surfaces 70 and 72 of the airfoils. The molten metal does not engage portions of the ends 73 of the airfoils 24 which are covered by the ceramic mold material 40 (FIG. 8). However, the molten metal in the inner and outer shroud ring mold cavities 44 and 46 goes completely around each of the airfoils 24 so that the end portions 32 and 36 of the airfoils are circumscribed by the molten metal.

Once the molten metal has been poured, the airfoils 24 act as a chill. Therefore, the molten metal solidifies in a direction extending transverse to the central axes of the airfoils 24. However, shrinkage defects are not formed in the axially upper and lower end portions of the inner and outer shroud ring mold cavities 44 and 46. This is because the gating passages are effective to maintain a supply of molten metal to the upper and lower end portions of the shroud ring mold cavities 44 and 46 as the molten metal in the shroud ring mold cavities solidifies.

During solidification of the molten metal in the shroud ring mold cavities 44 and 46, a metallurgical bond does not form between the inner and outer shroud rings 26 and 28 and the end portions 32 and 36 of the airfoils 24. This is because the outer surface of the airfoils 24 is covered with an oxide coating which is formed during processing of the airfoils in the atmosphere. This oxide coating prevents the forming of a metallurgical bond between the airfoils 24 and the inner and outer shroud rings 26 and 28. Therefore, there is only a mechanical bond between the inner and outer shroud rings 26 and 28 and the end portions 32 and 36 of the airfoils 24.

The molten metal which solidifies to form the inner and outer shroud rings 26 and 28 has a different composition than the composition of the airfoils 24. Thus, the airfoils 24 are formed of a nickel-chrome alloy. The inner and outer shroud rings 26 and 28 are formed of cobalt chrome superalloy, such as MAR M509. Although the shroud rings 26 and 28 are formed of the same metal, they could be formed of different metals if desired. If the shroud rings 26 and 28 are to be formed of different metals, two separate gating systems would have to be provided, that is, one gating system for the inner shroud ring mold cavity 44 and a second gating system for the outer shroud ring mold cavity 46. Of course, each gating system would have its own downpole and pour cup.

During use of the stator 20 (FIG. 1), the airfoils 24 are exposed to gas which comes directly from the combustion chamber. The airfoils 24 becomes hotter than the inner and outer shroud rings 26 and 28. Therefore, the airfoils tend to expand axially outwardly, that is in a radial direction relative to the shroud rings 26 and 28. In the absence of the slip joints 58 between each of the airfoils and the outer shroud ring 28, substantial thermal stresses would be set up in the airfoils and the inner and outer shroud rings.

Figure 3:
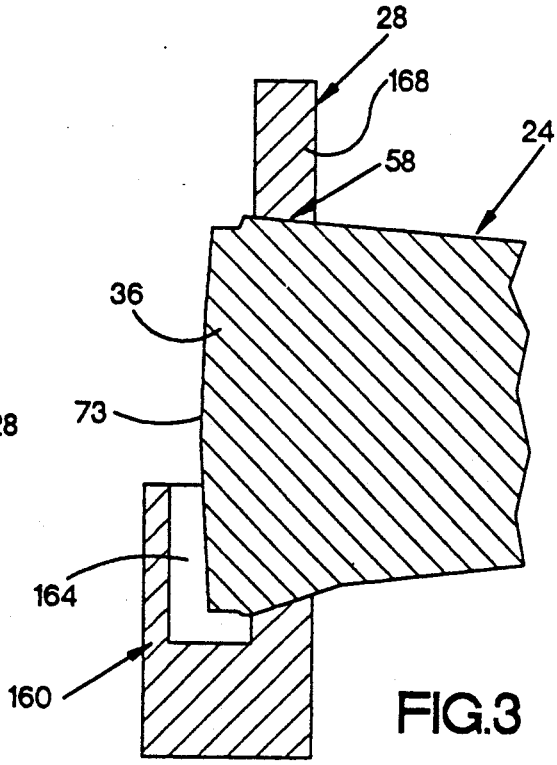
FIG. 3 is a sectional view, taken generally along the line 3—3 of FIG. 2, illustrating the relationship between the airfoil and a space in the shroud ring rail to accommodate thermal expansion of the airfoil.

When the inner and outer shroud rings 26 and 28 and airfoils 24 are at the same temperature, the slip joints 58 are tightly closed, in the manner illustrated schematically in FIGS. 2 and 3. However, when the airfoils 24 are heated to a temperature which is above the temperature of the inner and outer shroud rings 26 and 28, the airfoils expand radially outwardly relative to the shroud rings. As this occurs, the slip joints 58 open, as shown schematically in FIG. 4. As the slip joints 58 open, the tapering side surfaces 66 and 68 on the outer end portions 36 of the airfoils 24 move away from similarly tapering inner side surfaces 152 and 154 on the inside of openings 156 in the outer shroud ring 28.

Figure 4:
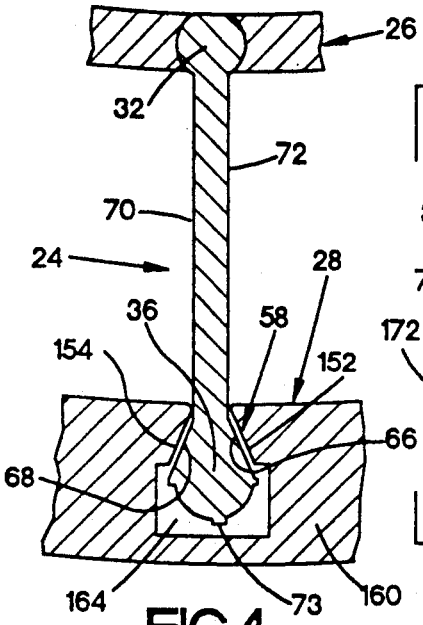
FIG. 4 is a fragmentary sectional view, generally similar to FIG. 2, illustrating the manner in which thermal expansion of the airfoil opens a slip joint as the airfoil expands into the space in the shroud ring rail.

The slip joints 58 can readily move from the closed condition of FIG. 2 to the open condition of FIG. 4 under the influence of thermal expansion forces since there is no metallurgical bond between the outer shroud ring 28 and the end portion 36 of the airfoil 24. This is due to the oxide coatings which covers the end portions 36 of the airfoils before molten metal is poured into the shroud ring mold cavity. It should be noted that the inner end portion 32 of each airfoil 24 is mechanically anchored in the inner shroud ring 26. This prevents the airfoils 24 from moving out of engagement with the inner shroud ring 26 as the slip joints 58 open.

Although the slip joints 58 have been shown herein as being between the end portion 36 of the airfoil and the outer shroud ring 28, it is contemplated that the slip joint could be provided between the inner end portion 32 of the airfoil 24 and the inner shroud ring 26. In the illustrated embodiment of the invention, the inner and outer shroud rings 26 and 28 are positioned in a concentric relationship with the airfoils 24 disposed in a radially extending annular array between the shroud sections. In certain known turbine engine components, the shroud rings have the same diameter and the airfoils extend in an axial direction between the shroud rings. Of course, these shroud rings could be cast around performed airfoils in much the same way as in which the shroud rings 26 and 28 are cast around the airfoils 24. It is contemplated that suitable slip joints could also be provided between the airfoils and shroud rings in this type of turbine engine component.

Shroud Ring Rail

In accordance with a feature of the present invention the turbine engine component 20 is provided with an annular shroud ring rail 160 (FIG. 1). The shroud ring rail 160 facilitates mounting of the turbine engine component 20 and strengthens the turbine engine component. The shroud ring rail 160 could be formed on the inner and/or outer shroud rings. The relatively thick annular rail is provided with space 164 (FIGS. 1, 2, 3, and 4) to accommodate thermal expansion of the airfoils 24. If the space 164 was not provided, the airfoils 24 could not expand relative to the shroud ring 28 in the manner previously explained.

The shroud ring 28 has a generally cylindrical main or body section 168 (FIGS. 1 and 3). The relatively thick annular rail 160 is disposed adjacent to one axial end portion of the body section 168 and projects radially outwardly from the body section (FIG. 1). The rail 160 overlaps the outer end portion 36 of each of the airfoils 24. Thus, the rail 160 extends across the outer end portions 36 of the airfoils 24 (FIGS. 1-3). Since the rail 160 overlaps the ends of the airfoils 24, in the absence of the space 164, the rail 160 would block outward movement of the airfoils 24 relative to the shroud ring 28 and would lock the airfoils in place.

By providing the rail 160 with the space 164, the airfoils 24 are free to expand axially in a radial direction relative to the shroud ring 28 from the retracted condition shown in FIG. 2, in which the slip joint 58 is closed, to the extended condition shown in FIG. 4, in which the slip joint 58 is open. As thermal expansion of an airfoil 24 occurs relative to the outer shroud ring 28, the end portion 36 of the airfoil moves into a space 164 (FIG. 4). The radial extent of the space 164 relative to the shroud ring 28 is sufficient to accommodate the maximum possible axial expansion of an airfoil 24 in a radial direction relative to the shroud ring during a complete range of operating conditions for the turbine engine component 20. Similarly, the circumferential or sideways extent of the space 164 is large enough to accommodate the maximum width of the end portion 36 of the airfoil 24 (FIG. 2).

During fabrication of the turbine engine component 20, the space 164 in the shroud ring rail 160 is formed by the use of core material 172 (FIGS. 5-10) which is disposed at outer end portions 36 of the airfoils 24. The ceramic core material 172 may be of any desired one of many known compositions, such as the compositions disclosed in U.S. Pat. Nos 4,093,017; 4,097,292; 4,164,424; 4,190,450; or 4,236,568. It should be understood that the specific composition of the core material 172 is not, per se, a feature of the present invention and that any desired core material may be used.

Figure 5:
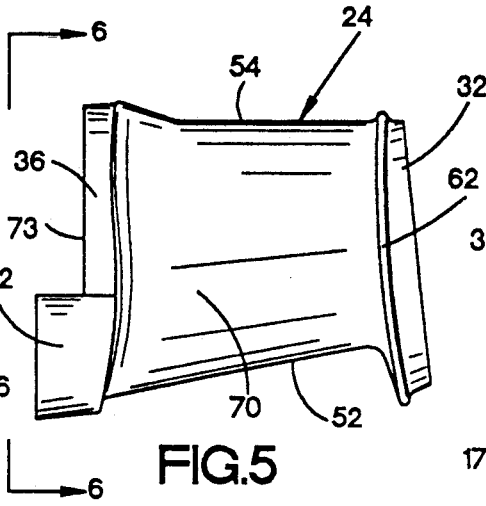
FIG. 5 is a plan view of an airfoil used in the turbine engine component of FIG. 1 and illustrating the manner in which core material is connected with one end of the airfoil.

The core material 172 may be preformed as a separate body which is connected to the outer end portion 36 of an airfoil 24 in the manner illustrated in FIGS. 5 and 6. However, the core material 172 could be molded in place at the end portion 36 of an airfoil if desired.

The core material has a length, as measured along an axis extending parallel to a longitudinal central axis of the airfoil 24 (FIG. 5), which is greater than the maximum possible distance through which the airfoil 24 may expand relative to the shroud ring 28 during operation of the turbine engine component. The core material has a width, as measured along an axis extending perpendicular to the longitudinal central axis of the airfoil 24 (FIG. 6), which is greater than the width of the end portion 36 of the airfoil 24. By providing the core material with a length which is greater than the maximum possible extent of thermal expansion of the airfoil 24 relative to the shroud ring 28 and a width (FIG. 6) which is greater than the width of the end portion 36 of the airfoil, a space 164 (FIGS. 2 and 3) which is formed by the body of core material 172 is large enough to receive the end portion 36 of the airfoil 24 during thermal expansion of the airfoil relative to the shroud ring 28. If desired, the size of the end portion 36 of the airfoil 24 could be reduced to enable the size of the space 164 to be reduced.

The preformed body of core material 172 is secured to the end portions 36 of the airfoils 24 by a combination of mechanical interlocking and adhesive bonding. The shroud ring patterns 34 and 38 are then formed (injected) around the inner and outer end portions 32 and 36 of the airfoils 24. The annular shroud ring patterns 34 and 38 may be formed of interconnected wax pattern segments which are connected with the opposite end portions 32 and 36 of the airfoils 24 and the core material 172. However, the shroud ring patterns 34 and 38 could each be cast as one-piece around the end portions 32 and 36 of the airfoils if desired.

Regardless of how the annular shroud ring patterns 34 and 38 are formed, the wax material of the shroud ring pattern 38 extends around the outer end portions 36 of the airfoils 24 and the core material 172. Thus, the pattern material directly engages the sloping side surfaces 66 and 68 on the end portions 36 of the airfoils (FIG. 7). The wax pattern material also engages and extends around the core material 172 (FIGS. 7 and 8). The shroud ring pattern material 38 extends across the outer end surfaces of the core material 172 and the outer end portions 36 of the airfoils 24. The pattern material 38 is also disposed between bodies 172 of core material (FIG. 7).

The airfoils 24, shroud ring patterns 34 and 38, and core material 172 are covered by the ceramic mold material 40. This may be accomplished by dipping a pattern assembly in a slurry of ceramic mold material. It should be noted that the ceramic mold material 40 abuttingly engages and bonds with an end surface 176 and a side surface area 177 (FIG. 8) of the core material 172. Thus, the ceramic mold material 40 abuttingly engages or overlies the shroud ring pattern material 38, the core material 172, and the end portion 36 of the airfoil 24. Although side surface area 177 of the core material 172 has been shown in FIG. 8 as being spaced a relatively large distance from the end 73 of the airfoil 24, the side surface area 177 may be spaced 0.030 of an inch or less from the end of the airfoil.

After the ceramic mold material 40 has dried, or at least partially dried, the wax material forming the inner and outer shroud ring patterns 34 and 38 is removed from the mold 42 to leave the annular shroud ring mold cavities 44 and 46 (FIG. 9). At this time, the core material 172 is supported in the shroud ring mold cavity 46 by the end portions 36 of the airfoils 24 and the ceramic mold material 40. Thus, force is transmitted between the core material 172 and the airfoils 24 and between the core material and the mold material 40 to support the core material. Although the core material 172 engages and is bonded to the ceramic mold material 40 (FIG. 8), there is space between a portion of the radially outer end of the core material 172 and the ceramic mold material 40 (FIG. 9). This space extends across the ends 36 of the airfoils 24.

After the wax material forming the inner and shroud ring patterns 34 and 38 has been removed, the mold 42 is preheated. During preheating, the airfoils 24 expand relative to the ceramic mold material 40. This thermal expansion of the airfoils 24 breaks bonds between the core material 172 and the end portions 36 of the airfoils 24. However, the core material 172 is pressed against the mold material 40 by the end portions 36 of the airfoils 24. This results in the core material 172 being gripped between the end portions 36 of the airfoils 24 and the ceramic mold material 40 to hold the core material against movement relative to the shroud ring mold cavity 46.

After the mold 42 has been preheated, molten metal is poured into the mold. The molten metal is conducted by suitable gating (not shown) into the annular shroud ring mold cavities 44 and 46 to form the shroud rings 26 and 28 (FIG. 10). During pouring, the molten metal engages the core material 172. The core material 172 is firmly held against movement relative to the shroud ring mold cavity 46 by being gripped between the outer end portions 36 of the airfoils 24 and ceramic mold material 40.

The shroud ring 28 encloses the outer end portions 36 of the airfoils 24 and the ceramic core material 172. The metal of the shroud ring 28 extends across the ends of the airfoils 24 in the space between the core material 172 and a cylindrical mold surface 178 (FIG. 10) to form the shroud ring rail 160. Thus, the shroud ring rail 160 is formed with a continuous cylindrical outer side surface (see FIGS. 1 and 10) which circumscribes and is coaxial with the annular array 22 of airfoils 24.

After the molten metal in the shroud ring mold cavities 44 and 46 has solidified, the ceramic mold material 40 is removed from the outside of the airfoils 24 and shroud rings 26 and 28. The core material 172 is then removed from inside the shroud ring rail 160 with a suitable core removal solution or bath of molten salts. This leaves spaces 164 at the outer end portions of the airfoils 24. Since there is no metallurgical bond between the airfoils 24 and the shroud ring 28 and since there is open space 164 at the outer end portions of the airfoils, the airfoils are free to expand radially outwardly relative to the shroud ring 28 from the retracted condition of FIG 2 to the extended condition of FIG 4. Thus, even though the shroud ring rail 160 overlaps or extends across the end portions 36 of the airfoils 24, the space 164 will accommodate thermal expansion of the airfoils.

In one specific embodiment of the turbine engine component 20, the airfoils 24 expanded radially outwardly relative to the shroud ring from the retracted condition of FIG. 2 to the extended condition of FIG. 4 through a distance of less than 0.020 of an inch. Therefore, the open space 164 at the outer ends of the airfoils 24 had an extent, measured along the central axes of the airfoils of 0.030 of an inch or slightly less. The extent of expansion of the airfoils 24 radially outwardly relative to the shroud ring will depend upon the length of the airfoils and the temperature differential in the turbine engine component 20. Of course, if the axial expansion of the airfoils 24 was different, the extent of the open space 164 would be different.

In the illustrated embodiment of the invention, the core material 172 is formed as a plurality of separate, generally rhombic blocks (FIGS. 5, 6 and 7). However, it is contemplated that the core material 172 could be formed as a one-piece annular ring if desired. If this was done, an annular groove would be formed in the rail 160

(FIGS. 1 and 3) which is cast as one-piece with the body 168 of the shroud ring 28. However, it is believed that the strength of the turbine engine component 20 may be enhanced by forming the space 164 as separate, generally rhombic recesses disposed outwardly of each of the airfoils 24 rather than as a continuous annular ring.

Shroud Ring With Plural Rails

Figure 11:
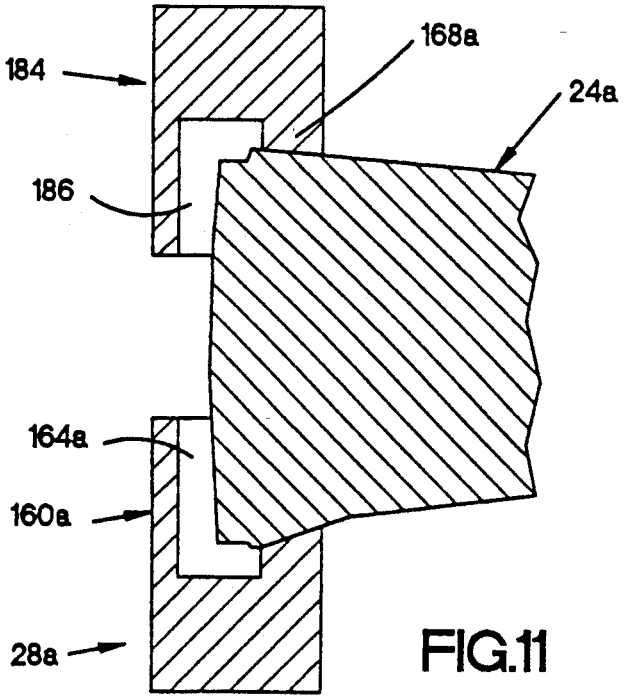
FIG. 11 is a fragmentary sectional view, generally similar to FIG. 3, and illustrating an embodiment of the invention in which a shroud ring is provided with a pair of rails having space to accommodate thermal expansion of the airfoils.

In the embodiment of the invention illustrated in FIGS. 1-10, the one-piece cast circular shroud ring 28 is formed with a single mounting rail or flange 160. In the embodiment of the invention illustrated in FIG. 11, the one-piece cast shroud ring is formed with a pair of annular rails or flanges. Since the embodiment of the invention illustrated in FIG. 11 is generally similar to the embodiment of the invention illustrated in FIGS. 1-10, similar numerals will be utilized to designate similar components, the suffix letter "a" being associated with the embodiment of the invention illustrated in FIG. 11 to avoid confusion.

An annular array of airfoils or vanes **24*a* extend between an inner shroud ring (not shown) and a one-piece cast outer shroud ring 28*a*. The metal airfoils 24*a* are allows the airfoils to be formed of a metal which is different than the metal forming shroud ring 28*a***.

The circular shroud ring **28*a* includes an annular lower mounting rail or flange 160*a* and an annular upper rail or mounting flange 184. The annular rails 160*a* and 184 are cast as one-piece with a generally cylindrical body portion 168*a* of the shroud ring 28*a*. A space 164*a* is provided in the lower flange 160*a* to accommodate thermal expansion of the airfoil 24*a*. Similarly, space 186 is provided in the upper rail 184 to accommodate thermal expansion of the airfoil 24*a*. The space 186 in the upper flange 184 of the shroud ring 28*a* has the same configuration as the space 164*a* in the lower rail 160*a* of the shroud ring 28*a*. The two spaces 164*a* and 186 are formed using core material, corresponding to the core material 172 of FIGS. 5, 6 and 7, in the same manner as previously explained in conjunction with the embodiment of the invention disclosed in FIGS. 1-10**.

Core Material Support Arrangements

In the embodiment of the invention illustrated in FIGS. 1-10, the core material 172 is secured to the end portions 36 of the airfoils 24 (FIGS. 5-7). This results in the core material being held in place in the shroud ring mold cavity 46 by mechanical and adhesive connections between the core material 172 and the end portions 36 of the airfoils 24 and by abutting engagement of the core material with the ceramic mold material 40 (FIG. 8). In the embodiment of the invention illustrated in FIG. 12, the core material is not bonded to the airfoils. Thus, in this embodiment the ceramic mold material is bonded to the core material to hold the core material against movement relative to the airfoils. The core material is also gripped between the ends of the airfoils and the ceramic mold material. Since the embodiment of the invention illustrated in FIG. 12 is generally similar to the embodiment of the invention illustrated in FIGS. 1-10, similar numerals will be utilized to designate similar components, the suffix letter "b" being associated with the components of FIG. 12 to avoid confusion.

A plurality of airfoils **24*b* are disposed in an annular array. End portions 36*b* of the airfoils 24*b* are enclosed by a shroud ring pattern 38*b* having a configuration which corresponds generally to the configuration of the shroud ring 28 of FIG. 1. Core material 172*b* is disposed at the outer end portion 36*b* of the airfoil 24*b* of FIG. 12. Prior to application of the ceramic mold material 40*b*, the core material 172*b* is partially supported by the shroud ring pattern 38*b*. The airfoil 24*b*, shroud ring pattern 38*b* and core material 172*b* are covered with ceramic mold material 40*b* in the manner previously explained in conjunction with the embodiment of the invention shown in FIGS. 1-10**.

Figure 12:
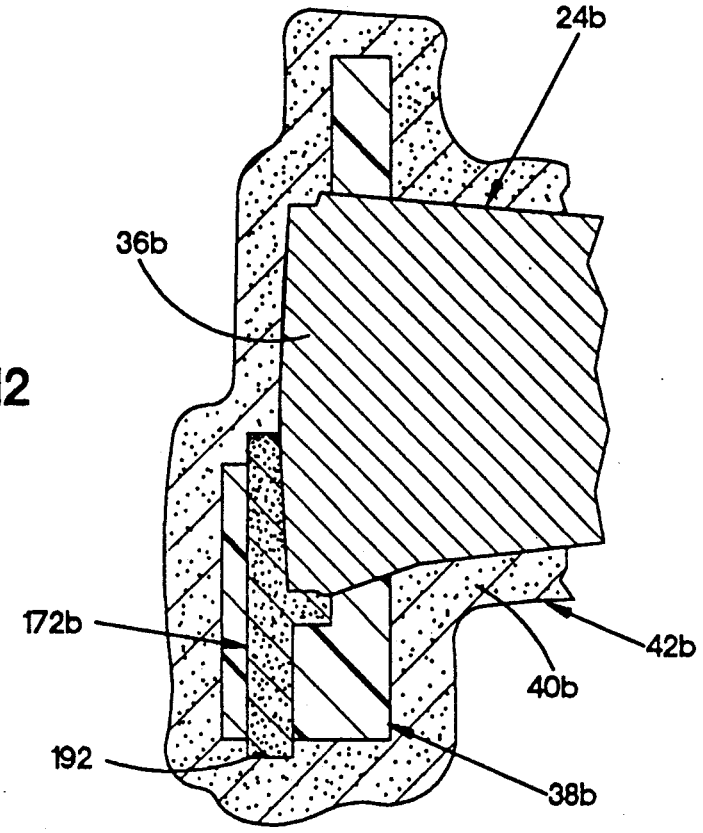
FIG. 12 is a sectional view, generally similar to FIG. 8, illustrating an embodiment of the invention in which core material is gripped by ceramic mold material.

In accordance with a feature of the embodiment of the invention shown in FIG. 12, the core material **172*b* is free of direct bonds or connections to the airfoils 24*b*. The core material 172*b* is gripped by the ceramic mold material 40*b* to hold the core material in place in a shroud ring mold cavity after a shroud ring pattern 38*b* has been removed from the mold 42*b*. Thus, an end portion 192 of the core material 172*b* extends downwardly (as viewed in FIG. 12) from the shroud ring pattern 38*b*. Opposite sides of the projecting portion 192 of the core material 172*b* are engaged by the mold material 40*b*. Similarly, an end portion of the core material 172*b*** extends upwardly and is bonded to the ceramic mold material.

When the mold material **40*b* has been dried and dewaxed, the mold material firmly grips and is bonded to the projecting portions of the core material 172*b* to hold the core material against movement relative to the airfoil 24*b*. Thus, the core material 172*b* is at least partially supported and held in place by force which is transmitted through bonds between the core material and the mold material 40*b*. When the mold is preheated, thermal expansion of the airfoil 24*b* presses the core material 172*b* against the ceramic mold material 40*b*** to clampingly grip the core material.

In the embodiment of the invention illustrated in FIG. 12, the core material **172*b* is disposed in engagement with the end portion 36*b* of the airfoil 24*b* in the same manner as previously explained in conjunction with the embodiment of the invention shown in FIGS. 1-10. However, the connection between the core material 172*b* and the end portion 36*b* of the airfoil 24*b* has been eliminated. This is because the mold material 40*b* grips the core material 172*b* to hold it in position in a shroud ring mold cavity formed by removing the shroud ring pattern 38*b***.

With the exception of the projecting portion 192, the core material **172*b* has a generally rectangular configuration similar to the configuration of the core material 172 of FIGS. 5-7. Thus, a body of core material 172*b* is provided at the outer end portion 36*b* of each of the airfoils 24*b*. However, if desired, the core material 172*b* could have a body or main portion with an annular configuration so that the core material may form a continuous ring around an annular array of airfoils 24*b*. If this was done, the core material would be provided with a plurality of spaced apart projecting portions 192 which would be bonded with the ceramic mold material 40*b***.

Figure 13:
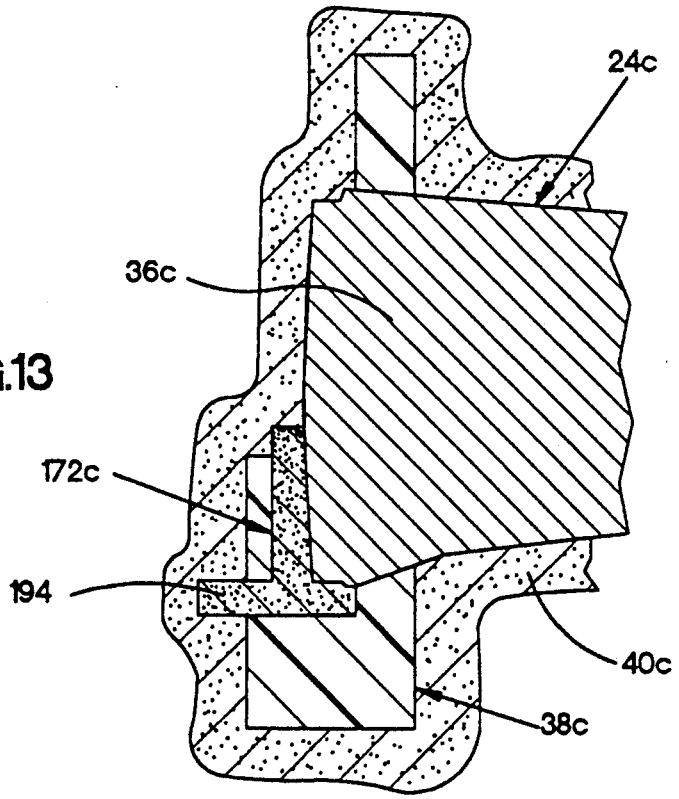
FIG. 13 is a sectional view, generally similar to FIGS. 8 and 12, illustrating another embodiment of the invention in which core material is gripped by ceramic mold material.

In the embodiment of the invention illustrated in FIG. 13, the core material is provided with a sidewardly projecting portion which is gripped by the ceramic mold material. Since the embodiment of the invention illustrated in FIG. 13 is generally similar to the embodiment of the invention illustrated in FIGS. 1-10, similar numerals will be utilized to designate similar components, the suffix letter "c" being associated with FIG. 13 to avoid confusion.

An annular array of airfoils or vanes 24c have end portions 36c which are enclosed by a shroud ring pattern 38c. The core material 172c is provided with a projecting portion 194 which is gripped by ceramic mold material 40c. The ceramic mold material 40c engages opposite sides of the projection 194 to firmly hold the core material 172c against movement relative to the airfoil 24c after the shroud ring pattern 38c has been removed and the mold material fired. Thus, the core material 172c is at least partially supported by force which is transmitted between the core material and the mold material 40c.

In this embodiment of the invention, the projection 194 extends outwardly from the end portion 36c of the airfoil 24c in a direction generally parallel to the central axis of the airfoil 24c. Although an interconnection is provided between the core material 172c of FIG. 13 and the end portion 36c of the airfoil 24c in the same manner as previously explained in conjunction with the embodiment of the invention illustrated in FIGS. 1-10, the core material 172c could be held in place in a shroud ring mold cavity by only the ceramic mold material 40c.

In the embodiment of the invention illustrated in FIG. 13, the projecting portion 194 has a generally cylindrical configuration and projects outwardly from a generally rectangular body of core material. However, it is contemplated that the body of core material from which the portion 194 projects could have an annular configuration if desired.

Rather than forming the projecting portion 194 with a vertical (as viewed in FIG. 13) extent which is substantially less than the vertical extent of the main body and core material 172c, the projection 194 could have a vertical extent which is co-extensive with the remainder of the body of core material. If this was done, an opening would be formed in the outer side surface of the shroud ring rail. This opening would be at least co-extensive with the amount of overlap of the shroud ring rail with the end portion 36c of the airfoil 24c.

Coating Core Material

In the embodiments of the invention illustrated in FIGS. 5-13, the core material is preformed to a desired configuration and placed at the ends of the airfoils. However, to reduce manufacturing costs, the core material 172 is placed at the ends of the airfoils 24 by applying a coating of core material over the end portions 36 of the airfoils at locations outwardly of the surfaces 66 and 68 (FIGS. 4 and 7). The coating of core material bonds directly to the end portions 36 of the airfoils 24. In addition, bonds are subsequently formed between the ceramic mold material 40 and the core material 172.

The coating of ceramic mold material 172 may be applied to areas on the end portions of the airfoils 24 in many different ways. However, it is presently preferred to apply the coating of core material 172 by painting a liquid slurry of core material on the end portions 36 of the airfoils 24, that is, by applying a wet coating with a brushing or swabing movement. Of course, the coating of core material could be painted on the end portions 36 of the airfoils by spraying. It is also contemplated that a coating of the core material 172 could be applied by dipping the end portions of the airfoils in a liquid slurry of core material.

The thickness of the coating of core material may be 0.030 of an inch or less depending upon the extent of expansion of the airfoils 24. Of course, the thickness of the coating of core material can be varied by varying the number of layers in a coating of core material applied to the end portions of the airfoils. The specific coating thickness selected will be a function of the anticipated thermal expansion of the airfoils 24 relative to the shroud ring 28. However, with turbine engine components similar to the turbine engine component 20, it is believed that a coating of 0.030 of an inch or less will provide adequate expansion space.

As the coating of core material on end portions 36 of the airfoils 24 is dried, bonds are formed between the coating and the end portions of the airfoils. These bonds connect the coating to the airfoils. After the coating of core material has dried, the wax material of the shroud ring pattern 38 is injected and partially encloses the coating of core material. A portion of the core material projects outwardly from the wax material of the shroud ring pattern 38 and is engaged by and bonds with the ceramic material 40.

After the wax material forming the inner and shroud ring patterns 34 and 38 has been removed, the mold 42 is preheated. During preheating, the airfoils 24 expand relative to the ceramic mold material 40. This thermal expansion of the airfoils 24 breaks the connections between the coating of core material 172 and the end portions 36 of the airfoils 24. However, the coating of core material 172 is pressed against the mold material 40 by the end portions 36 of the airfoils 24. This results in the coating of core material 172 being gripped between the end portions 36 of the airfoils 24 and the ceramic mold material 40 to hold the coating of core material against movement relative to the shroud ring mold cavity 46.

Conclusion

The present invention provides a new and improved method of making an improved turbine engine component 20 having a plurality of airfoils 24 disposed in an annular array 22 between shroud rings 26 and 28. Space 164 is provided in a rail 160 on at least the shroud ring 28 to accommodate thermal expansion of the airfoils 24. When this improved turbine engine component is to be made, a plurality of airfoils 24 are positioned in an annular array 22 with end portions 36 of the airfoils at least partially enclosed by a shroud ring pattern 38. Core material 172 is disposed at the end portions 36 of the airfoils 24. The core material may be either preformed to a desired configuration or coated over end portions 36 of the airfoils 24.

After the shroud ring pattern 38 and core material 172 have been covered with ceramic mold material 40, the shroud ring pattern is removed to leave a shroud ring mold cavity 46 in which the core material 172 is at least partially disposed. Thermal expansion of the airfoils 24, during preheating of the mold 42, breaks connections between the core material 172 and the airfoils. The core material 172 is then held against movement relative to the shroud ring mold cavity 46 by being gripped between end portions 36 of the airfoils 24 and the ceramic mold material 40. The shroud ring mold cavity 46 is filled with molten metal which is solidified to form the shroud ring 28. After the molten metal has solidified, the core material 172 is removed from the shroud ring 28 to leave space 164 to accommodate thermal expansion of the airfoils 24. In turbine engine components 20, similar to the illustrated turbine engine components, the space 164 provided by the core material had an extent of 0.030 of an inch or less outwardly from the ends of the airfoil 24. Of course, the specific size of the space 164 may be different for different turbine engine components.

Although the shroud ring rail 160 (FIG. 1) or rails 160*a* and 184 (FIG. 11) have been described herein as being on the outer shroud ring 28, they could be formed on the inner shroud ring 26. Of course, rails could be provided on both the inner and outer shroud rings 26 and 28. In addition, the slip joints 58 could be formed in the inner shroud ring 26 or in both the inner and outer shroud rings. Of course, space, corresponding to the space 164, could be provided in an inner shroud ring rail to accommodate thermal expansion of the airfoils.

Having described specific preferred embodiments of the invention, the following is claimed:

1. A method of making a turbine engine component having a plurality of airfoils disposed in an annular array between an inner shroud ring and an outer shroud ring, said method comprising the steps of positioning a plurality of airfoils having leading and trailing edge portions extending between inner and outer end portions of the airfoils in an annular array with outer end portions of the airfoils at least partially embedded in an annular outer shroud ring pattern which extends across at least a portion of the outer end portion of each of the airfoils and with inner end portions of the airfoils at least partially embedded in an annular inner shroud ring pattern, covering the shroud ring patterns with ceramic mold material to form a mold, removing the material of the shroud ring patterns from the mold to leave coaxial inner and outer shroud ring mold cavities having annular configurations corresponding to the configurations of the shroud ring patterns, the inner and outer end portions of the airfoils being at least partially disposed in the shroud ring mold cavities, filling the inner and outer shroud ring mold cavities with molten metal, said step of filling the inner and outer shroud ring mold cavities with molten metal including the steps of at least partially enclosing the inner end portions of the airfoils with a first annular body of molten metal having a configuration corresponding to the configuration of the inner shroud ring and at least partially enclosing the outer end portions of the airfoils with a second annular body of molten metal having a configuration corresponding to the configuration of the outer shroud ring, said steps of at least partially enclosing the inner and outer end portions of the airfoils with annular bodies of molten metal including conducting molten metal into a portion of at least one of the shroud ring mold cavities which extends across an end portion of each of the airfoils, and solidifying the molten metal in the inner and outer shroud ring mold cavities to form the inner and outer shroud rings, said step of solidifying the molten metal including solidifying the molten metal in the inner shroud ring mold cavity around the inner end portions of the airfoils and solidifying the molten metal in the outer shroud ring mold cavity around the outer end portions of the airfoils, said step of solidifying molten metal in the shroud ring mold cavities including solidifying the molten metal in at least one of the shroud ring mold cavities across an end portion of each of the airfoils.

2. A method as set forth in claim 1 wherein said step of solidifying molten metal in the shroud ring mold cavities across an end portion of each of the airfoils includes solidifying molten metal across an outer end portion of each of the airfoils.

3. A method as set forth in claim 1 wherein said step of solidifying molten metal in the shroud ring mold cavities includes solidifying the molten metal with space between end portions of the airfoils and the metal solidified across the end portions of the airfoils to accommodate thermal expansion of the airfoils during use of the turbine engine component.

4. A method as set forth in claim 1 further including the step of engaging end portions of the airfoils with core material, said step of at least partially enclosing the inner and outer end portions of the airfoils with the molten metal includes at least partially enclosing the core material with molten metal, said method further including removing the core material from the solidified molten metal.

5. A method of making a turbine engine component having a shroud ring with a plurality of airfoils disposed in an annular array, said method comprising the steps of positioning a plurality of airfoils in an annular array with end portions of the airfoils at least partially enclosed in a shroud ring pattern, at least partially covering the shroud ring pattern with ceramic mold material to form a mold, removing the shroud ring pattern from the mold to leave a shroud ring mold cavity in which the end portions of the airfoils are disposed, filling the shroud ring mold cavity with molten metal, said step of filling the shroud ring mold cavity with molten metal includes engaging the end portions of the airfoils disposed in the shroud ring mold cavity with the molten metal, the solidifying the molten metal in the shroud ring mold cavity to form the shroud ring, said step of solidifying molten metal in the shroud ring mold cavity including solidifying molten metal across the ends of the airfoils with the metal solidified across the ends of the airfoils spaced from the ends of the airfoils.

6. A method as set forth in claim 5 wherein said step of solidifying molten metal in the shroud ring mold cavity includes leaving joints between the end portions of the airfoils and the solidified metal in the shroud ring mold cavity free of bonds to enable thermal expansion to occur between the airfoils and the shroud ring during use of the turbine engine component.

7. A method of making a turbine engine component having a plurality of airfoils disposed in an annular array between an inner shroud ring and an outer shroud ring, said method comprising the steps of positioning a plurality of airfoils having leading and trailing edge portions extending between inner and outer end portions of the airfoils in an annular array with outer end portions of the airfoils at least partially embedded in an annular outer shroud ring pattern which extends across at least a portion of the outer end portion of each of the airfoils and with inner end portions of the airfoils at least partially embedded in an annular inner shroud ring pattern, covering the shroud ring patterns with ceramic mold material to form a mold, removing the material of the shroud ring patterns from the mold to leave coaxial inner and outer shroud ring mold cavities having annular configurations corresponding to the configurations of the shroud ring patterns, the inner and outer end portions of the airfoils being at least partially disposed in the shroud ring mold cavities, filling the inner and outer shroud ring mold cavities with molten metal, said step of filling the inner and outer shroud ring mold cavities with molten metal including the steps of at least partially enclosing the inner end portions of the airfoils with a first annular body of molten metal having a configuration corresponding to the configuration of the inner shroud ring and at least partially enclosing the outer end portions of the airfoils with a second annular body of molten metal having a configuration corresponding to the configuration of the outer shroud ring, said steps of at least partially enclosing the inner and outer end portions of the airfoils with annular bodies of molten metal including conducting molten metal into a portion of at least one of the shroud ring mold cavities which extends across an end portion of each of the airfoils, solidifying the molten metal in the inner and outer shroud ring mold cavities to form the inner and outer shroud rings, said step of solidifying molten metal in the shroud ring mold cavities including solidifying molten metal across end portions of the airfoils in one of the shroud ring mold cavities during the formation of one of the shroud rings, and forming cavities in the one shroud ring between the end portions of the airfoils and the metal solidified across end portions of the airfoils to accommodate thermal expansion between the airfoils and one shroud ring.

8. A method as set forth in claim 7 further including the step of engaging end portions of the airfoils with core material, said steps of at least partially enclosing the inner and outer end portions of the airfoils with molten metal includes at least partially enclosing the core material with the molten metal, said step of forming cavities in the one shroud ring including removing core material from the one shroud ring.

9. A method of making a turbine engine component having a shroud ring with a plurality of airfoils disposed in an annular array, said method comprising the steps of positioning a plurality of airfoils in an annular array with end portions of the airfoils at least partially enclosed in a shroud ring pattern, at least partially covering the shroud ring pattern with ceramic mold material to form a mold, removing the shroud ring pattern from the mold to leave a shroud ring mold cavity in which the end portions of the airfoils are disposed, filling the shroud ring mold cavity with molten metal, said step of filling the shroud ring mold cavity with molten metal includes engaging the end portions of the airfoils disposed in the shroud ring mold cavity with the molten metal, solidifying the molten metal in the shroud ring mold cavity to form the shroud ring, and forming space in the shroud ring extending across ends of the airfoils in a circumferential direction along the shroud ring, said step of solidifying molten metal in the shroud ring mold cavity includes leaving joints between the end portions of the airfoils and the solidified metal in the shroud ring mold cavity free of bonds to enable thermal expansion to occur between the airfoils and the shroud ring during use of the turbine engine component.

10. A method of making a turbine engine component having a shroud ring with a plurality of airfoils disposed in an annular array, said method comprising the steps of positioning a plurality of airfoils in an annular array with end portions of the airfoils at least partially enclosed in a shroud ring pattern, at least partially covering the shroud ring pattern with ceramic mold material to form a mold, removing the shroud ring pattern from the mold to leave a shroud ring mold cavity in which the end portions of the airfoils are disposed, filling the shroud ring mold cavity with molten metal, said step of filling the shroud ring mold cavity with molten metal includes engaging the end portions of the airfoils disposed in the shroud ring mold cavity with the molten metal, solidifying the molten metal in the shroud ring mold cavity to form the shroud ring, and forming space in the shroud ring extending across ends of the airfoils in a circumferential direction along the shroud ring, said step of forming space in the shroud ring includes forming in the shroud ring an annular array of cavities which extend radially beyond the annular array of airfoils.

11. A method as set forth in claim 10 wherein said step of solidifying molten metal in the shroud ring mold cavity includes solidifying molten metal across ends of the airfoils.

12. A method of making a turbine engine component having a shroud ring with a plurality of airfoils disposed in an annular array, said method comprising the steps of positioning a plurality of airfoils in an annular array with end portions of the airfoils at least partially enclosed in a shroud ring pattern, at least partially covering the shroud ring pattern with ceramic mold material to form a mold, removing the shroud ring pattern from the mold to leave a shroud ring mold cavity in which the end portions of the airfoils are disposed, filling the shroud ring mold cavity with molten metal, said step of filling the shroud ring mold cavity with molten metal includes engaging the end portions of the airfoils disposed in the shroud ring mold cavity with the molten metal, solidifying the molten metal in the shroud ring mold cavity to form the shroud ring, and forming in the shroud ring an annular array of cavities which extend radially beyond the annular array of airfoils, said step of solidifying molten metal in the shroud ring mold cavity includes leaving joints between the end portions of the airfoils and the solidified metal in the shroud ring mold cavity free of bonds to enable thermal expansion of the airfoils into the cavities in the shroud ring to occur during use of the turbine engine component.

13. A method of making a turbine engine component having a shroud ring with a plurality of airfoils disposed in an annular array, said method comprising the steps of positioning a plurality of airfoils in an annular array with end portions of the airfoils at least partially enclosed in a shroud ring pattern, at least partially covering the shroud ring pattern with ceramic mold material to form a mold, removing the shroud ring pattern from the mold to leave a shroud ring mold cavity in which the end portions of the airfoils are disposed, filling the shroud ring mold cavity with molten metal, said step of filling the shroud ring mold cavity with molten metal includes engaging the end portions of the airfoils disposed in the shroud ring mold cavity with the molten metal, solidifying the molten metal in the shroud ring mold cavity to form the shroud ring, and forming in the shroud ring an annular array of cavities which extend radially beyond the annular array of airfoils, said step of solidifying molten metal in the shroud ring mold cavity includes solidifying molten metal across an end portion of each of the airfoils to form end surface areas for each of the cavities.

* * * * *

UNITED STATES PATENT AND TRADEMARK OFFICE

CERTIFICATE OF CORRECTION

PATENT NO. : 5,069,265

DATED : December 3, 1991

INVENTOR(S) : William S. Blazek

It is certified that error appears in the above-identified patent and that said Letters Patent is hereby corrected as shown below:

Column 16, Line 28, Claim 5, delete "the" (first occurrence) and insert --and--.

Signed and Sealed this

Thirtieth Day of March, 1993

*Attest:*

STEPHEN G. KUNIN

*Attesting Officer*

*Acting Commissioner of Patents and Trademarks*